US005490878A

United States Patent [19]

Peterson et al.

[11] Patent Number: 5,490,878

[45] Date of Patent: Feb. 13, 1996

[54] COATED ABRASIVE ARTICLE AND A METHOD OF MAKING SAME

[75] Inventors: Jeffrey S. Peterson, Hudson, Wis.; Donald L. Oseth, West St. Paul, Minn.

[73] Assignee: Minnesota Mining and Manufacturing Company, St. Paul, Minn.

[21] Appl. No.: 269,194

[22] Filed: Jun. 30, 1994

Related U.S. Application Data

[62] Division of Ser. No. 932,073, Aug. 19, 1992, Pat. No. 5,344,688.

[51] Int. Cl.[6] ..... B24D 11/02

[52] U.S. Cl. ..... 51/295; 51/297

[58] Field of Search ..... 51/293, 296, 295

[56] References Cited

U.S. PATENT DOCUMENTS

| | | | |
|---|---|---|---|
| 2,712,987 | 7/1955 | Storrs et al. | 51/293 |
| 3,230,672 | 1/1966 | Anthon | 51/404 |
| 3,787,273 | 1/1974 | Okrepkie et al. | 428/56 |
| 3,887,450 | 6/1975 | Gilano et al. | 204/159.15 |
| 3,895,949 | 7/1975 | Akamatsu et al. | 96/86 P |
| 4,047,903 | 9/1977 | Hesse et al. | 51/298 R |
| 4,163,647 | 8/1979 | Swiatek | 51/295 |
| 4,318,766 | 3/1982 | Smith | 156/330 |
| 4,457,766 | 7/1984 | Caul | 51/298 |
| 4,474,585 | 10/1984 | Gruber | 51/298 |
| 4,547,204 | 10/1985 | Caul | 51/298 |
| 4,588,419 | 5/1986 | Caul et al. | 51/295 |
| 4,652,274 | 3/1987 | Boettcher et al. | 51/298 |
| 4,652,275 | 3/1987 | Bloecher et al. | 51/298 |
| 4,722,203 | 2/1988 | Darjee | 66/202 |
| 4,735,632 | 4/1988 | Oxman et al. | 51/295 |
| 4,751,138 | 6/1988 | Tumey et al. | 428/323 |
| 4,799,939 | 1/1989 | Bloecher et al. | 51/293 |
| 4,867,760 | 9/1989 | Yarbrough | 51/298 |
| 4,903,440 | 2/1990 | Larson et al. | 51/298 |
| 4,927,431 | 5/1990 | Buchanan et al. | 51/298 |
| 5,344,688 | 9/1994 | Peterson et al. | 428/102 |

FOREIGN PATENT DOCUMENTS

| | | |
|---|---|---|
| 0344529 | 12/1989 | European Pat. Off. . |
| 2087263 | 5/1982 | United Kingdom . |

OTHER PUBLICATIONS

Kaswell, *Wellington Sears Handbook of Industrial Textiles*, Wellington Sears Company, Inc. (New York: 1963), pp. 451–452.

*Primary Examiner*—Deborah Jones
*Attorney, Agent, or Firm*—Gary L. Griswold; Walter N. Kirn; Daniel R. Pastirik

[57] ABSTRACT

A coated abrasive article comprising (a) a porous backing having a front side and a back side;

(b) in direct contact with the porous backing, a make coat formed from a composition comprising a radiation curable adhesive applied over the front side of the backing;

(c) a multiplicity of abrasive grits bonded by the make coat to the front side of the backing; and (d) a size coat overlying both the abrasive grits and the make coat.

The invention also involves several methods for preparing the coated abrasive article. In all of these methods, a radiation curable make coat precursor is applied directly to the front side of the porous backing. No treatment coat is required to seal the backing prior to application of the make coat precursor.

18 Claims, 1 Drawing Sheet

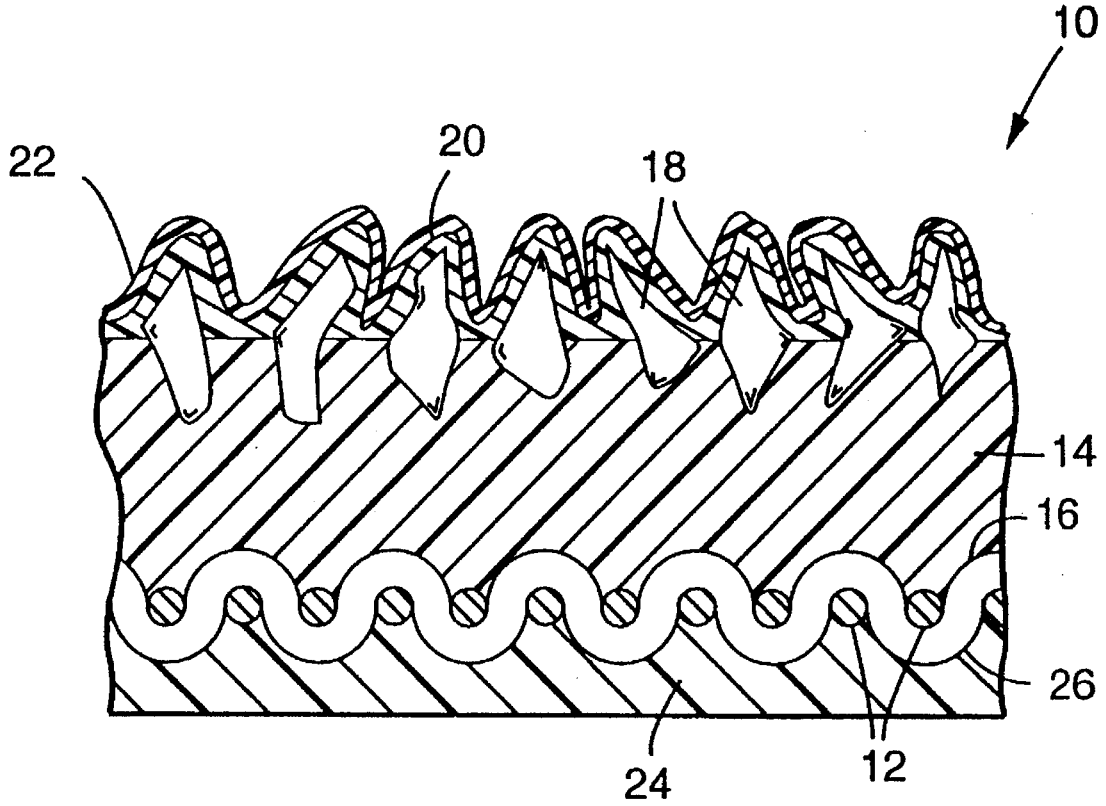
10
22
20
18
14
16
26
24
12

COATED ABRASIVE ARTICLE AND A METHOD OF MAKING SAME

This is a division of application Ser. No. 07/932,073 filed Aug. 19, 1992, now U.S. Pat. No. 5,344,688.

BACKGROUND OF THE INVENTION

1. Field of Invention

This invention relates to a coated abrasive article and to a method of making such an article.

2. Discussion of the Art

Coated abrasive articles generally comprise a flexible backing to which is adhered a coating of abrasive grits. The coated abrasive article typically employs a "make coat" of resinous adhesive material in order to secure or bond the abrasive grits to the backing and a "size coat" of resinous material applied over the make coat and abrasive grits in order to firmly bond the abrasive grits to the backing.

The flexible backing can be made of cloth, paper, polymeric film, nonwoven materials, vulcanized fiber, and combinations thereof. Cloth is widely used as a coated abrasive backing on account of its strength, heat resistance, and flexibility. However, cloth backings have some major disadvantages. Cloth backings are generally more expensive than other types of backings. Additionally, because cloth backings are generally porous, they have to be sealed or treated, thereby significantly adding to their cost. If the cloth backing is not sealed, the make coat will penetrate into the interstices of the cloth, resulting in a deficiency of binder, and the subsequently applied abrasive grits will not adhere to the backing. The cloth backing is typically sealed by one or more treatment coats, such as a saturant coat, a presize coat, a backsize coat, or a subsize coat. A saturant coat saturates the cloth, resulting in a stiffer cloth with more body. An increase in body provides an increase in strength and durability of the article. A presize coat, which is applied to the front side of the backing, may add bulk to the cloth or may improve adhesion of subsequent coatings. A presize coat also protects the yarns of the cloth. A presize coat is extremely useful for coated abrasive articles utilizing fine grades of abrasive grits. A backsize coat, which is applied to the back side of the backing, i.e., the side opposite to which the abrasive grits are applied, adds body to the backing and protects the yarns of the cloth from wear. A subsize coat is similar to a saturation coat except that it is applied to a previously treated backing.

These treatment coats typically comprise thermally curable resinous adhesives, such as phenolic resins, epoxy resins, acrylate resins, acrylic latices, latices, urethane resins, glue, starch and combinations thereof.

U.S. Pat. No. 2,712,987 discloses a coated abrasive having a nylon substrate. The nylon softened and then the abrasive grits are applied. The nylon serves both as the backing and as the make coat.

U.S. Pat. No. 3,230,672 discloses a coated abrasive in which the abrasive grits have been forced into the make coat such that the height of the abrasive grits is essentially the same.

U.S. Pat. No. 4,163,647 discloses a method of making a cloth backed coated abrasive in which the cloth is coated on its front side with a liquid thermosetting resin in such a manner that the thermosetting resin does not permeate the interstices of the cloth.

A utility cloth having the tradename of "VORAX" has a make coat that does not penetrate the interstices of the cloth.

The make coat is selected from the group consisting of glue, phenolic resins, latices, or phenolic resins/latices.

In recent years radiation curable resins have been proposed as cloth treatments or binders for coated abrasives as a substitute for conventional thermally curable resins. Radiation curable resins can be cured much more rapidly than can phenolic resins. If additional heat is provided in an attempt to more rapidly cure phenolic resins, the viscosity of the phenolic resin will decrease, thereby resulting in bleeding of the resin through the backing. As a result of this bleed through, the backing hardens and loses flexibility.

U.S. Pat. Nos. 4,047,903; 4,588,419; 4,927,431; 4,903,440 disclose abrasive articles comprising abrasive grits and a binder formed from a radiation curable resin.

SUMMARY OF THE INVENTION

This invention provides a coated abrasive article and a method for making such an article.

There are two primary aspects of this invention. In the first aspect, the coated abrasive article comprises:

a. a porous backing having a front side and a back side;

b. in direct contact with the porous backing, a make coat formed from a composition comprising a radiation curable adhesive applied over the front side of the porous backing;

c. a multiplicity of abrasive grits bonded by the make coat to the front side of the backing;

d. a size coat overlying both the abrasive grits and the make coat.

A porous backing is a backing that is not sealed. The preferred material for a porous backing is cloth. Typically, a cloth will not have any type of resinous treatment applied to it. However, the manufacturer may apply a treatment to some of the yarns to facilitate weaving of the cloth. A cloth may be dyed, stretched, or have adhesion promoters on the surface of the cloth yarns.

The precursor of the make coat comprises at least one radiation curable adhesive. A radiation curable adhesive is any resinous or adhesive material (with the addition of an appropriate curing agent or initiator, if necessary) that can be partially cured or completely cured by exposure to radiation energy. Examples of sources of radiation energy include electron beam, ultraviolet light, and visible light. In most instances, radiation curable adhesives contain an $\alpha,\beta$-unsaturated carbonyl group. Such groups include acrylates, methacrylates, acrylamides, and methacrylamides. Curing or polymerization occurs via a free radical mechanism at the site of the $\alpha,\beta$-unsaturated group.

The precursor of the make coat can comprise other adhesive materials besides the radiation curable adhesive. For example, the make coat precursor can contain a blend of a radiation curable adhesive and a condensation curable resin. Examples of other adhesive materials that are not radiation curable and that can be incorporated in the make coat precursor include phenolic resins, epoxy resins, urethane resins, urea-formaldehyde resins, melamine formaldehyde resins, and latices.

The precursor of the size coat is a material that can be applied over the abrasive grits, and, upon being cured, further reinforces the abrasive grits. The size coat precursor can be any glutinous or resinous adhesive. Examples of such resinous adhesives include phenolic resins, acrylate resins, aminoplast resins, epoxy resins, urethane resins, polyester resins, urea-formaldehyde resins, and combinations thereof.

The make coat precursor or the size coat precursor or both can contain additives that are commonly used in the abrasive industry. These additives include fillers, grinding aids, dyes, pigments, coupling agents, surfactants, lubricants, etc., and mixtures thereof.

The second aspect of the invention involves methods of preparing the coated abrasive article.

In one embodiment of the second aspect, the method of making the coated abrasive article comprises the steps of:

a. providing a porous backing having a front side and a back side;

b. applying a make coat precursor comprising a radiation curable adhesive directly to the front side of the backing;

c. applying a multiplicity of abrasive grits into the make coat precursor;

d. exposing the make coat precursor to a source of radiation energy to at least partiality cure the make coat precursor, whereby the make coat precursor seals the backing and serves to bond the abrasive grits to the backing;

e. applying a size coat precursor over the abrasive grits; and f. completely curing the make coat and size coat precursors.

In a second embodiment of the second aspect, the method of making a coated abrasive article comprises the step of completely curing the make coat precursor prior to applying the size coat precursor;

In a third embodiment of the second aspect, the method of making a coated abrasive article comprises the steps of:

a. providing a porous backing having a front side and a back side;

b. applying a make coat precursor comprising a radiation curable adhesive directly to the front side of the backing;

c. exposing the make coat precursor to a source of radiation energy to partially cure the make coat precursor;

d. applying a multiplicity of abrasive grits into the make coat precursor, whereby the make coat precursor seals the backing and serves to bond the abrasive grits to the backing;

e. applying a size coat precursor over the abrasive grits; and f. completely curing the make coat and size coat precursors.

In a variation of the third embodiment, the make coat precursor can be fully cured before the size coat precursor is applied.

In the methods of making the coated abrasive article of this invention, the make coat precursor and the size coat precursor are applied in liquid or semi-liquid state, while the resinous components of the precursors are uncured or unpolymerized. The term "partially cured" means that the resin has begun to polymerize and has increased in molecular weight, but is still soluble in an appropriate solvent. The term "fully cured" means that the resin is polymerized, in a solid state, and not soluble in the foregoing solvent. The resinous components in the make coat precursor and the size coat precursor are completely cured or polymerized to form the make coat and the size coat, respectively, of the coated abrasive article.

The make coat precursor directly contacts the backing. No treatment coat is required to seal the backing prior to application of the make coat precursor. It is preferred that the make coat precursor be applied to the porous backing in such a manner that the make coat precursor does not substantially penetrate the interstices of the porous backing. One method of application involves the use of a die coater, such as a slotted die coater. Alternatively, depending upon the viscosity of the make coat precursor, a knife coater or other suitable coater may be used.

The make coat serves both to adhere the abrasive grits to the backing and to seal the backing. The process of this invention combines two processing steps into one, resulting in reduced expense. Because less coating material is needed in this method, the resultant product is more flexible. Greater flexibility generally promotes greater conformability of the coated abrasive article when in use. In addition, the method of this invention tends to improve mineral orientation, because the rapid gelling of the make coat precursor tends to anchor the mineral in place more rapidly.

BRIEF DESCRIPTION OF THE DRAWING

FIG. 1 is a side view of a coated abrasive article of the invention.

DETAILED DESCRIPTION

Referring to FIG. 1, a coated abrasive article 10 comprises a porous backing 12 having a front side 16 and a back side 26, a make coat 14 applied over the front side 16 of the porous backing 12. The make coat 14 is in direct contact with the front side 16 of the porous backing 12. No intermediate treatment coat is between the make coat 14 and the front side 16 of the porous backing 12. The make coat 14 secures abrasive grits 18 to the backing 12. Overlying the abrasive grits 18 is a size coat 20. It is also within the scope of this invention to have a supersize coat 22 applied over the size coat 20. The coated abrasive article 10 may also have a backsize coat 24 applied to the back side 26 of the porous backing 12.

As used herein, the term "porous" means having a porosity greater than zero, as defined by ASTM Committee D13, ASTM Standards on Textile Materials, American Society for Testing Materials, Philadelphia, Pa. (1961). According to that definition, $$\text{Porosity } P = \frac{V_v}{V_t} \times 100$$

where

P=porosity $V_v$=volume of voids in the fabric $V_t$=total volume of the fabric

See also Kaswell, *Wellington Sears Handbook of Industrial Textiles,* Wellington Sears Company, Inc. (New York: 1963), pp. 451–452, incorporated herein by reference.

As a practical matter, porosity for backings made of textile materials is preferably measured by an apparatus known as a Gurley Densitometer. The Gurley Densitometer measures the amount of time, in seconds, required for 100 cubic centimeters of air to pass through the backing. This apparatus and procedures for its use are well known in the textile industry. Briefly, the backing to be tested is secured at one end of the hollow metal cylinder of the densitometer. A piston that fits very tightly within the cylinder is then raised to allow exactly 100 cubic centimeters of air at room temperature and pressure into the space between the backing and the piston. A timer is started at the precise moment that the force of gravity causes the piston to fall toward the backing. The time for the 100 cubic centimeters of air to pass through the backing is measured. If the time is less than 100 seconds, preferably less than 50 seconds, the backing is considered porous for the purposes of the present invention. If the time is greater than 150 seconds, preferably greater than 300 seconds, the backing is considered to be sealed. The same test can also be used for backings that are made from materials other than textiles. In the case of paper, however, 100 cubic centimeters of air must pass through the backing in less than 30 seconds, preferably less than 10 seconds in order for the backing to be considered porous.

The porous backing is preferably made of cloth. The cloth is composed of yarns in the warp direction, i.e., the machine direction, and yarns in the fill direction, i.e., the cross direction. The cloth backing can be a woven backing, a stitchbonded backing, or a weft insertion backing. Examples of woven constructions include sateen weaves of 4 over one weave of the warp yarns over the fill yarns; twill weave of 3 over one weave; plain weave of one over one weave and a drill weave of two over two weave. In a stitchbonded fabric or weft insertion backing, the warp and fill yarns are not interwoven, but are oriented in two distinct directions from one another. The warp yarns are laid on top of the fill yarns and secured to one another by a stitch yarn or by an adhesive. See, for example, U.S. Pat. Nos. 4,722,203 and 4,867,760, both of which are incorporated herein by reference.

The fibers or yarns in the porous backing can be natural, synthetic, or combinations thereof. Examples of materials of natural fibers and yarns include cellulosics, such as cottons, hemp, kapok, flax, sisal, jute, carbon, manila, and combinations thereof. Examples of materials of synthetic fibers and yarns include polyesters, polypropylenes, glasses, polyvinyl alcohols, polyimides, polyamides, rayon and other cellulosics, nylons, polyethylenes, and combinations thereof. The preferred materials for fibers and yarns of this invention are cottons, polyesters, nylons, blends of at least one polyester and at least one cotton, rayon, and polyamides.

The cloth backing can be dyed and stretched, wet and stretched, desized, or heat-stretched. Additionally the yarns in the cloth backing can contain primers, dyes, pigments or wetting agents. The yarns can be twisted or texturized. Polyester and polyamide yarns can be ring spun, open end, monofilament, multifilament, or core spun.

The denier of the fibers should be less than about 2,000, preferably between about 100 to 1,500. The yarn size should range from about 1,500 to 12,000 meters/kilogram. The weight of the untreated cloth of the backing will range from about 0.15 to about 1 kg/m$^2$, preferably from about 0.15 to about 0.75 kg/m$^2$. The cloth backing preferable has a high surface area.

Slashing coatings, such as polyvinyl alcohol (PVA), can be provided on yarns. A "slashing" coating is typically used to allow the yarns to be more easily woven. Polyester yarns useful in the present invention may include a slashing coating.

A porous cloth backing will have openings between adjacent yarns. The yarns of the cloth generally are not protected. However, the yarns in cloth can be subjected to some type of surface treatment, such as, for example, treatments with adhesion promoters, wetting agents, desizing agents, or dyes.

The make coat precursor of this invention comprises a radiation curable adhesive. A radiation curable adhesive can be defined as any resinous adhesive material that, along with the proper curing agent, if necessary, can be partially cured or completely cured by exposure to radiation energy. Examples of sources of radiation energy include electron beam, ultraviolet light, and visible light. Typically, the radiation curable adhesive has an α,β-unsaturated carbonyl group and cures or polymerizes by a free radical mechanism at the site of the α,β-unsaturated carbonyl group. These so called α,β-unsaturated carbonyl groups include acrylate, methacrylate, acrylamide, and methacrylamide groups.

Typically, radiation curable adhesives suitable for this invention are selected from acrylated urethanes, acrylated epoxies, acrylated polyesters, ethylenically unsaturated compounds, aminoplast derivatives having pendant unsaturated carbonyl groups, isocyanurate derivatives having at least one pendant acrylate group, isocyanate derivatives having at least one pendant acrylate group, epoxy resins, and mixtures and combinations of the foregoing.

Acrylated urethanes are diacrylate esters of hydroxy terminated NCO extended polyesters or polyethers. Examples of commercially available acrylated urethanes include "UVITHANE 782", available from Morton Thiokol Chemical, and "EBECRYL 6600", "EBECRYL 8400", and "EBECRYL 8805", available from Radcure Specialties.

Acrylated epoxies are diacrylate esters, such as the diacrylate esters of bisphenol A epoxy resin. Examples of commercially available acrylated epoxies include "EBECRYL 3500", "EBECRYL 3600", and "EBECRYL 3700", available from Radcure Specialties.

Examples of acrylated polyesters include the "PHOTOMER 5000" series resins, available from the Henkel Corp.

Ethylenically unsaturated compounds include monomeric and polymeric compounds that contain atoms of carbon, hydrogen, and oxygen, and optionally, nitrogen and the halogens. Oxygen or nitrogen atoms or both are generally present in ether, ester, urethane, amide, and urea groups. The compounds preferably have a molecular weight of less than about 4000, and they are preferably esters formed by reaction of compounds containing aliphatic monohydroxy and polyhydroxy groups with unsaturated carboxylic acids, such as acrylic acid, methacrylic acid, itaconic acid, crotonic acid, isocrotonic acid, maleic acid, and the like. Representative examples of ethylenically unsaturated compounds preferred for this invention include methyl methacrylate, ethyl methacrylate, styrene, divinylbenzene, vinyl toluene, ethylene glycol diacrylate, ethylene glycol methacrylate, hexanediol diacrylate, triethylene glycol diacrylate, triethylene glycol methacrylate, trimethylolpropane triacrylate, glycerol triacrylate, pentaerythritol triacrylate, pentaerythritol trimethacrylate, pentaerythritol tetraacrylate, pentaerythritol tetramethacrylate, dipentaerythritol pentaacrylate, sorbitol triacrylate, and sorbitol hexaacrylate. Other examples of ethylenically unsaturated compounds include ethylene glycol diitaconate, 1,4-butanediol diitaconate, propylene glycol dicrotonate, dimethyl maleate, and the like; monoallyl, polyallyl, and polymethallyl esters and amides of carboxylic acids, such as diallyl phthalate, diallyl adipate and, N,N-diallyladipamide, tris(2-acryloyl-oxyethyl)isocyanurate, 1,3,5-tri(2-methacryloxyethyl)-s-triazine, acrylamide, methylacrylamide, N-methylacrylamide, N,N-dimethylacrylamide, N-vinylpyrrolidone, and N-vinylpiperidone.

Aminoplast derivatives having pendant α,β-unsaturated carbonyl groups are further described in U.S. Pat. No. 4,903,440 and U.S. Ser. No. 659,752, filed Feb. 23, 1991, incorporated herein by reference.

Isocyanurate derivatives having at least one pendant acrylate group and isocyanate derivatives having at least one pendant acrylate group are further described in U.S. Pat. No.

4,652,274, incorporated herein by reference. The preferred isocyanurate material is a triacrylate of tris(hydroxy)ethyl isocyanurate.

Another radiation curable adhesive suitable for this invention is an epoxy resin that cures via a cationic polymerization mechanism with the addition of an appropriate curing agent. This is further described in U.S. Pat. Nos. 4,318,766 and 4,751,138 both of which are incorporated herein by reference.

The radiation curable adhesive may require a curing agent to initiate polymerization. If the radiation curable adhesive is cured by electron beam radiation, a curing agent is not always required. However, for radiation sources such as ultraviolet light or visible light, a curing agent or initiator is typically required. When the curing agent or initiator is exposed to either ultraviolet or visible light, a free-radical source is generated that initiates the polymerization of the adhesive.

Examples of curing agents or initiators that generate free radicals when exposed to ultraviolet light include organic peroxides, azo compounds, quinones, benzophenones, nitroso compounds, acryl halides, hydrazones, mercapto compounds, pyrylium compounds, triacrylimidazoles, bisimidazoles, chloroalkytriazines, benzoin ethers, benzil ketals, thioxanthones, and acetophenone derivatives. Additional references to free radical photoinitiator systems for ethylenically-unsaturated compounds are included in U.S. Pat. No. 3,887,450 (e.g., col. 4) and U.S. Pat. No. 3,895,949 (e.g., col. 7).

Examples of curing agents or initiators that generate free radicals when exposed to visible light can be found in U.S. Pat. No. 4,735,632, incorporated herein by reference.

The make coat precursor must comprise at least one radiation curable adhesive; however, the make coat precursor can further comprise a mixture of two or more radiation curable adhesives, a mixture of at least one radiation curable adhesive and at least one thermally curable resin, or a mixture of two or more radiation curable adhesives and at least one thermally curable resin. Thermally curable resins preferred for this invention are phenolic resins and acrylonitrile latex resins. When a thermally curable resin is used, the ratio by weight of radiation curable adhesive or adhesives to thermally curable resin or resins preferably ranges from about 90:10 to about 10:90.

Condensation curable resins are one species of thermally curable resins. Condensation curable resins for this invention are typically selected from phenolic, urea-formaldehyde, and melamine-formaldehyde resins. Phenolic resins are preferred because of their thermal properties, availability, cost, and ease of handling. There are two types of phenolic resins, resole and novolac. Resole phenolic resins are catalyzed by alkaline catalysts and the ratio of formaldehyde to phenol is greater than or equal to one, typically between 1.5:1 to 3.0:1. Examples of alkaline catalysts are sodium hydroxide, barium hydroxide, potassium hydroxide, calcium hydroxide, organic amines, and sodium carbonate. Resole phenolic resins are thermosetting resins and, when cured, exhibit excellent toughness, dimensional stability, strength, hardness, and heat resistance.

Both the resole and novolac phenolic resins, with the addition of the appropriate curing agent or initiator for the novolac phenolic resin, are cured by thermal energy. Examples of phenolic resins are commercially available under the following tradenames: "VARCUM", available from Occidental Chemical Corporation, "AEROFENE", available from Ashland Chemical Co., "BAKELITE", available from Union Carbide, and "RESINOX", available from Monsanto.

Examples of latex resins that can be mixed into the make coat precursor include acrylonitrile butadiene emulsions, acrylic emulsions, butadiene emulsions, butadiene styrene emulsions, and combinations of the foregoing. These latex resins are commercially available from a variety of different sources including: "RHOPLEX" and "ACRYLSOL", commercially available from Rohm and Haas Company, "FLEXCRYL" and "VALTAC", commercially available from Air Products & Chemicals Inc., "SYNTHEMUL" and "TYLAC", commercially available from Reichold Chemical Co., "HYCAR" and "GOODRITE", commercially available from B. F. Goodrich, "CHEMIGUM", commercially available from Goodyear Tire and Rubber Co., "NEOCRYL", commercially available from ICI, "BUTAFON", commercially available from BASF, and "RES", commercially available from Union Carbide.

Epoxy resins that are useful in the make coat precursors of this invention have an oxirane ring, i.e.

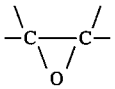

Opening of the oxirane ring can be initiated by an acidic or a basic catalyst. This reactive group then reacts with other resins in the mixture to bring about crosslinking. Epoxy resins suitable for this invention include monomeric epoxy compounds and polymeric epoxide compounds, and they may vary greatly in the nature of their backbones and substituent groups. For example, the backbone may be of any type and may contain any substituent group free of an active hydrogen atom that is reactive with an oxirane ring at room temperature. Epoxy resins can be cured by means of thermal or radiation energy.

The ratio of the radiation curable adhesive to the thermally curable resin in the make coat precursor can range from about 100:0 parts to 10:90 parts, preferably from about 75:25 to 25:75 parts, and most preferably is about 50:50 parts.

The viscosity of the make coat precursor should range from about 500 centipoise to about 10,000 centipoise, preferably from about 2,000 to 5,000 centipoise, at 25° C. A compatible organic solvent or water can be added to the make coat precursor to adjust the coating viscosity.

In some instances, when a latex resin is employed in the make coat precursor, the water associated with the latex resin will cause the viscosity of resulting make coat precursor to be too low. In this instance, it is preferred to add a thixotropic agent to the make coat precursor. An example of a commercially available thioxotropic agent is "ACRYSOL G-110", available from Rohm and Haas.

A major benefit of this invention is that the make coat precursor both seals the porous backing and secures the abrasive grits to the backing. It is preferred that the make coat precursor not substantially penetrate the interstices of the porous backing. If the make coat precursor substantially penetrates the interstices of the backing, there may not be sufficient make coat precursor to secure the abrasive grits to the backing. Porous backings are conventionally sealed with a first coating, i.e., a presize, and then a second coating, i.e., the make coat precursor, is applied. By combining two coating steps into one, while still maintaining a high level of coated abrasive performance, this invention represents an advance in the art.

Abrasive grits suitable for this invention typically have a Moh hardness of at least 7, preferably at least 8. Typical examples of materials suitable for the abrasive grits of this invention include aluminum oxide, heat treated aluminum oxide, ceramic aluminum oxide, silicon carbide, diamond, cerium oxide, boron carbide, cubic boron nitride, garnet, and mixtures thereof. The term "abrasive grits" also encompasses agglomerates containing abrasive grits, such as those described in U.S. Pat. Nos. 4,652,275 and 4,799,939. The abrasive grits can be of a size typically used in coated abrasive articles. The abrasive grits can be applied by drop coating or by electrostatic coating. The preferred method is electrostatic coating.

The size coat precursor can be any resinous or glutinous adhesive. Examples of size coat precursors suitable for this invention include phenolic resins, urea-formaldehyde resins, melamine resin, acrylate resins, urethane resins, epoxy resins, polyester resins, aminoplast resins, and combinations and mixtures thereof. The size coat precursor can also be a radiation curable adhesive of the type described previously. The preferred size coat precursors are phenolic resins and urea-formaldehyde resins.

The make coat precursor or the size coat precursor or both can contain optional additives. Such additives include fillers, fibers, lubricants, grinding aids, wetting agents, surfactants, pigments, dyes, antistatic agents, coupling agents, plasticizers, and suspending agents. Preferred fillers include calcium carbonate, calcium oxide, calcium metasilicate, alumina trihydrate, cryolite, magnesia, kaolin, quartz, and glass. Fillers that also function as grinding aids include cryolite, potassium fluoroborate, feldspar, and sulfur. Fillers can be used in amounts up to about 250 parts, preferably from about 30 to about 150 parts, per 100 parts of the make coat precursor or size coat precursor, the precise amount being selected to give the properties desired.

A backsize coat can be applied to the back side of the backing. The backsize coat can comprise any resinous material that serves to protect the yarns on the back side of a cloth backing. Examples of such resinous materials include phenolic resins, urea-formaldehyde resins, melamine resin, acrylate resins, urethane resins, epoxy resins, polyester resins, latices, glue, starches, aminoplast resins, and combinations and mixtures thereof. The backsize coat can also be a pressure-sensitive adhesive that can secure the coated abrasive article to a backup pad or a support pad. Examples of such pressure-sensitive adhesives include polyacrylates and polyacrylate block copolymers, natural rubber, SBR, and other elastomers mixed with tackifiers. Alternatively, a loop type fabric can be laminated to the back side of the backing for a hook and loop type attachment system for securing the coated abrasive article to a backup pad.

A supersize coat can be applied over the size coat. One type of supersize coat comprises a combination of a resinous adhesive with a grinding aid. Examples of resinous adhesives suitable for a supersize coat include phenolic resins, epoxy resins, acrylate resins, latices, urea-formaldehyde resins, and combinations thereof. Another type of supersize coat serves to minimize the amount of loading, i.e., abraded wood or paint dust that fills the area between the abrasive grits. Examples of such load-resisting supersize coats include metal stearates, waxes, lubricants, silicones, and fluorochemicals.

A variety of methods can be used to make the coated abrasive articles of this invention. In one embodiment, the make coat precursor is applied directly to the front side of the porous backing. In other words, no coating is between the front side of the porous backing and the make coat precursor. The make coat precursor is preferably applied in such a manner that it does not fully penetrate into the interstices of the porous backing; if full penetration occurs, there may not be sufficient make coat precursor to secure the abrasive grits to the backing. The amount of make coat precursor applied should be sufficient to ensure anchorage of the abrasive grits to the backing. The make coat precursor can be applied by a die coater. Depending on the viscosity of the coating, a knife coater, a curtain coater, or a roll coater can also be used. However, a die coater is preferred. The type of die coater and the dimensions thereof are not critical. The die coater can be a slot die coater or an orifice die coater. The pressure developed by the die coater should be sufficiently low to prevent forcing the make coat precursor into the interstices of the web.

As discussed previously, the viscosity of the make coat precursor preferably ranges from about 500 to about 10,000 centipoise, more preferably from 2,000 to 5,000 centipoise, at 25° C. If the viscosity is too low, too much of the make coat precursor will penetrate the interstices of the backing. Viscosity can be measured by means of a Brookfield viscometer using a #3 spindle at 12 rpm.

In the second step of this embodiment, the abrasive grits are applied into the make coat precursor. It is preferred that the abrasive grits be applied immediately after the make coat precursor is applied to the cloth backing. The abrasive grits are applied either by drop coating or by electrostatic coating, with electrostatic coating being preferred.

In the third step of this embodiment, the make coat precursor is exposed to a source of radiation energy to at least partially cure the make coat precursor. The three main sources of radiation energy for this step are electron beam, ultraviolet light, or visible light.

Electron beam radiation is also known as ionizing radiation. It preferably involves an energy level of 0.1 to 10 Mrad, more preferably an energy level of 1 to 10 Mrad. Ultraviolet light radiation is non-particulate radiation having a wavelength within the range of 200 to 700 nanometers, more preferably between 250 to 400 nanometers. Visible light radiation energy is non-particulate radiation having a wavelength within the range of 400 to 800 nanometers, more preferably between 400 to 550 nanometers.

The make coat precursor is at least partially cured to prevent it from further penetrating the interstices of the porous backing. However, in some instances, the make coat precursor comprises, in addition to the radiation curable adhesive, a thermally curable resin. In this case, the thermally curable resin may be cured at this point by exposure to thermal energy or may be cured at a later point in the process, for example, when the size coat precursor is cured. Thermal curing conditions will depend upon the chemistry and the amount of the thermally curable resin.

The make coat precursor can also be exposed to heat to effect thermal cure in addition to radiation cure.

In the fourth step of this embodiment, the size coat is applied over the abrasive grits. The size coat can be applied by any conventional technique, such as roll coating, spray coating, or curtain coating.

In the fifth step, the make coat precursor is completely cured, if necessary, and the size coat precursor is completely cured. Curing conditions will depend upon the chemistry of the resins or adhesives employed and their amounts. In some instances, it is preferred to subject the coated abrasive article to an extra thermal cure, for example, for a duration of about 6 hours at a temperature of about 115° C. It has been found that this extra thermal cure step increases the adhesion of the make coat to the cloth backing.

In another embodiment, the make coat precursor is fully cured by exposure to the source of radiation energy.

In still another embodiment, the make coat precursor is partially cured before the abrasive grits are applied and then fully cured immediately after the abrasive grits are applied. The purpose of the partial cure step is to prevent the make coat precursor from penetrating into the porous backing. It also been found that partial curing results in fewer multiple layers of abrasive grits being applied, especially in the fine grades. The make coat precursor is partially cured only to such a degree that it is still sufficiently tacky to secure the abrasive grits to the backing. The degree of partial cure is described in asignee's copending application, U.S. Ser. No. 07/823,861, filed Jan. 22, 1992 incorporated herein by reference.

The following non-limiting examples will further illustrate the invention. All coating weights are specified in grams/square meter. All formulation ratios are based upon weight.

In the examples, the following abbreviations are used:

| | |
|---|---|
| BM | A bisacrylamidomethyl ether made in a manner similar to that of Preparation 2 of U.S. Pat. No. 4,903,440. |
| RP1 | A sodium hydroxide catalyzed resole phenolic resin containing 74% solids and water and ethylene glycol monoethyl ether as the solvent. The phenolic resin contained between 0.3 to 0.5% by weight free formaldehyde, 2 to 4% by weight free phenol, and had a formaldehyde to phenol ratio of about 1.8:1. |
| BAM | A 55%/45% blend of BM and RP1, containing 82% solids. |
| AL | A carboxy modified butadiene acrylonitrile latex resin, commercially available from B. F. Goodrich. The percentage of solids was 45%. |
| PH1 | 2,2-dimethoxy-1,2-diphenyl-1-ethanone |
| TA | A thixotropic agent commercially available from Rohm & Haas under the trade designation "ACRYSOL G-110". |
| RP2 | A sodium hydroxide catalyzed resole phenolic resin, containing 70% solids and water as the solvent. The phenolic resin was made with paraformaldehyde and contained between 0.3 to 0.5% by weight free formaldehyde. |
| PP | An aliphatic polyester resin that serves as a plasticizer for the resole phenolic resin. The polyester resin does not react with the phenolic resin. |
| WA | A glycol ester of a fatty acid commercially available under the trade designation "INTERWET 33". The ester serves as a wetting agent. |
| WT | water |
| PS | A glycol ether solvent commercially available under the trade designation "POLYSOLVE". |
| UF1 | A urea-formaldehyde resin commercially available from Borden, Inc. under the trade designation "DURITE AL-8405". |
| FS | A feldspar filler having a mean particle size of 12 micrometers. |
| CACO3 | A calcium carbonate filler having an average surface diameter from 14 to 15 micrometers. |

The following test procedures were used to test coated abrasive articles made according to the examples.

SCHIEFER TEST

The coated abrasive article was converted into a 10.2 cm diameter disc and secured to a foam back-up pad by means of a pressure-sensitive adhesive. The coated abrasive disc/back-up pad assembly was installed on a Schiefer testing machine. The workpiece was a circular piece of acrylic plastic, about 1.25 cm thick and about 10 cm in diameter. The test endpoint was 500 revolutions or cycles of the coated abrasive disc. The amount of plastic removed from the workpiece was measured at the end of the test. In some instances, the surface finish (Ra and Rtm) of the workpiece was measured at the end of the test. Ra was the arithmetic average of the scratch size in microinches. Rtm was the mean of the maximum peak to valley height measured in microinches.

90° PEEL TEST

In order to measure the degree of adhesion between the backing and the make coat of a coated abrasive article, the coated abrasive sheet to be tested was converted into a sample about 8 cm wide by 25 cm long. One-half the length of a wooden board (17.78 cm by 7.62 cm by 0.64 cm thick) was coated with an adhesive. The entire width of, but only the first 15 cm of the length of, the coated abrasive sample was coated with an adhesive on the side bearing the abrasive material. In most instances, the adhesive was an epoxy resin with an appropriate curing agent. Then, the side of the sample bearing the abrasive material was attached to the side of the board containing the adhesive coating in such a manner that the 10 cm of the coated abrasive sample not bearing the adhesive overhung from the board. Pressure was applied such that the board and the sample were intimately bonded, and sufficient time was allowed for the adhesive to cure.

Next, the sample to be tested was scored along a straight line such that the width of the coated abrasive test specimen was reduced to 5.1 cm. The resulting coated abrasive sample/board composite was mounted horizontally in the lower jaw of a tensile testing machine having the trade designation "SINTECH", and approximately 1 cm of the overhanging portion of the coated abrasive sample was mounted into the upper jaw of the machine such that the distance between jaws was 12.7 cm. The machine separated the jaws at a rate of 0.5 cm/sec, with the coated abrasive sample being pulled at an angle of 90° away from the wooden board so that a portion of the sample separated from the board. Separation occurred between the cloth treatments and the cloth. The machine charted the force per centimeter of specimen width required to separate the cloth from the treatment coating. The higher the required force, the better adhesion of the treatment coating to the cloth backing.

Some of the articles of the examples were tested for 90° peel adhesion. The force required to separate the treatment was expressed in kg/cm. The results are set forth in Table IV. It is preferred that the force value be at least 1.8 kg/cm, more preferably at least 2 kg/cm.

EXAMPLES 1 AND 2 AND COMPARATIVE EXAMPLES A, B, AND C

The coated abrasive articles for this set of examples were tested according to the Schiefer Test and the results are set forth in TABLE I.

Example 1

The backing for this example was a J weight cotton backing that had been wet and stretched. However, the backing was not sealed. A make coat precursor was prepared from BAM (24.4 parts), AL (70.1 parts), PH1 (1.5 parts), and TA (3.0 parts). The make coat precursor was applied by means of a die coater to the front side of the backing at a wet weight of about 80 g/m$^2$. Immediately afterwards, grade 180 fused aluminum oxide was electrostatically projected into the make coat precursor at a weight of about 150 g/m$^2$. The resulting intermediate product was exposed to six (6) ultraviolet lights operating at 300 watts/inch at a feed rate of 0.2032 meter/second. The lamps were positioned so that the make coat was exposed to ultraviolet light immediately after being coated with abrasive grits. The intermediate product was cured for 30 minutes at a temperature of 88° C. Then, a size coat precursor was roll coated over the abrasive grits at a wet weight of about 80 g/m$^2$. The size coat precursor consisted of UF1 (6500 parts), FS (2100 parts), and aluminum chloride (452 parts, 10% solids in water), and WT (948 parts). The overall percentage of solids of the size coat precursor was 60%. The resulting intermediate product was heated for 45 minutes at a temperature of 66° C. After this thermal cure step, the resulting product was flexed prior to testing.

Example 2

The coated abrasive article for this example was made in the same manner as was used in Example 1, except that a different size coat precursor and thermal cure for the size coat precursor were employed. The size coat precursor consisted of RP2 (70.7 parts), PP (16.5 parts), WA (2.4 parts), WT (8.3 parts), and PS (2.1 parts). The overall percentage of solids of the size coat precursor was about 66%. The size coat precursor was cured by heat for 45 minutes at a temperature of 110° C.

Comparative Example A

The coated abrasive article for Comparative Example A was a grade 180 "3M 211 K Electro-Cut" J weight cloth coated abrasive commercially available from Minnesota Mining and Manufacturing Company, St. Paul, Minn.

Comparative Example B

The coated abrasive article for Comparative Example B was a grade 180 "3M 311T Blue Grit" J weight utility cloth coated abrasive commercially available from Minnesota Mining and Manufacturing Company, St. Paul, Minn.

Comparative Example C

The coated abrasive article for Comparative Example C was a grade 180 "Vorax" J weight utility cloth coated abrasive commercially available from Minnesota Mining and Manufacturing Company, France (Europe).

TABLE I

| Example | Total cut (g) | Percent of Comparative Example A |
|---|---|---|
| 1 | 0.932 | 114 |
| 2 | 0.987 | 110 |
| Comp. A | 0.816 | 100 |
| Comp. B | 1.129 | 138 |
| Comp. C | 1.123 | 138 |

EXAMPLES 3 THROUGH 8 AND COMPARATIVE EXAMPLES A, B AND D

This set of examples compared various greige cloth backings. The resulting coated abrasive articles were tested under the Schiefer Test and the test results are set forth in TABLE II.

Example 3

The backing for this example was a J weight cotton greige cloth backing that had a yarn count of 96 by 64. The backing had been stretched in the machine direction when wet. The make coat precursor for Example 3 was the same as was used in Example 2, and it was applied by means of a die coater to the front side of the backing at a wet weight of about 92 g/m$^2$. Immediately after the make coat precursor was applied, grade 180 fused aluminum oxide was electrostatically projected into the make coat precursor at a weight of about 150 g/m$^2$. The resulting product was exposed to four (4) ultraviolet lights operating at 300 watts/inch at a feed rate of 0.1524 meter/second. The product was then cured for 30 minutes at a temperature of 98° C. Following this step, a size coat precursor was roll coated over the abrasive grits at a wet weight of about 109 g/m$^2$. The size coat precursor and the thermal cure for the size coat were the same as was used in Example 2. After this thermal cure step, the resulting product was flexed prior to testing.

Example 4

The coated abrasive article for Example 4 was made in the same manner as was used in Example 3, except that a different size coat precursor and a different thermal cure for the size coat were employed. The size coat precursor and thermal cure were the same as was used in Example 1.

Example 5

The coated abrasive article for Example 5 was made in the same manner as was used in Example 3, except that a different backing was employed. The backing was a sub count J weight cotton greige cloth backing that had a yarn count of 86 by 54. The backing had been dyed and stretched.

Example 6

The coated abrasive article for Example 6 was made in the same manner as was used in Example 4, except that a different backing was employed. The backing was a sub count J weight cotton greige cloth backing that had a yarn count of 86 by 54. The backing had been dyed and stretched.

Example 7

The coated abrasive article for Example 7 was made in the same manner as was used in Example 3, except that a different backing was employed. The backing was a full count J weight cotton greige cloth backing that had a yarn count of 96 by 64.

Example 8

The coated abrasive article for Example 8 was made in the same manner as was used in Example 4, except that a different backing was employed. The backing was a full count J weight cotton greige cloth backing that had a yarn count of 96 by 64.

Comparative Example D

The coated abrasive article for Comparative Example D was made in the same manner as was used in Example 2, except that a different make coat precursor and cure for the make coat precursor were employed. The make coat precursor consisted of RP1 (27.4 parts), AL (70.4 parts), and TA (2.1 parts). After then abrasive grits were applied, but prior to application of the size coat precursor, the resulting coated abrasive article was thermally cured for 30 minutes at a temperature of 98° C.

TABLE II

| Example | Total cut (g) | Percent of Comparative Example A |
|---|---|---|
| 3 | 0.879 | 97 |
| 4 | 1.19 | 131 |
| 5 | 0.853 | 94 |
| 6 | 1.119 | 123 |
| 7 | 0.791 | 87 |
| 8 | 1.08 | 119 |
| Comp. A | 0.909 | 100 |
| Comp. B | 1.178 | 130 |
| Comp. D | 0.784 | 86 |

EXAMPLES 9 THROUGH 17 AND COMPARATIVE EXAMPLES A AND B

The coated abrasive articles of this set of examples were tested under the Schiefer Test. Compositions of the make coat precursor are set forth in TABLE III. The Schiefer Test results are set forth in TABLE IV.

TABLE III

| | Examples 9–12 | Examples 13–17 |
|---|---|---|
| BAM | 25.0 | 24.7 |
| AL | 72.0 | 71.0 |
| PH1 | 1.5 | 1.5 |
| TA | 1.5 | 2.8 |

Example 9

The backing for this example was a sub count J weight cotton greige cloth backing that had a yarn count of 86 by 54. The backing had been dyed and stretched. The make coat precursor was applied by means of a die coater to the front side of the backing at a wet weight of about 100 g/m$^2$. Immediately after the make coat precursor was applied, grade 180 fused aluminum oxide was electrostatically projected into the make coat precursor at a weight of about 150 g/m$^2$. The resulting product was exposed to five (5) ultraviolet lights operating at 300 Watts/inch at a rate of 0.2032 meter/second. The product was also thermally cured for 60 minutes at a temperature of 110° C. Then a size coat precursor was roll coated by means of a single roll kiss coater over the abrasive grits at a wet weight of about 125 g/m$^2$. The size coat precursor was the same as was used in Example 1, and it was thermally cured for 45 minutes at a temperature of 66° C. After this thermal cure step, the resulting product was flexed prior to testing.

Example 10

The coated abrasive article for this example was made in the same manner as was used in Example 9, except that a different size coat precursor, wet weight thereof, and curing conditions therefor were employed. The size coat consisted of RP1 (4870 parts), CACO3 (2510 parts), WT (2088 parts), PS (522 parts), and WA (10 parts). The wet weight of the size coat precursor was about 110 g/m$^2$. The size coat precursor was thermally cured for 45 minutes at a temperature of 110° C.

Example 11

The coated abrasive article for this example was made in the same manner as was used in Example 9, except that the make coat precursor and abrasive grits were exposed to one (1) ultraviolet lamp operating at 400 Watts/inch at a speed of 0.2032 meter/sec.

Example 12

The coated abrasive article for this example was made in the same manner as was used in Example 10, except that the make coat precursor and abrasive grits were exposed to one (1) ultraviolet lamp operating at 400 Watts/inch at a speed of 0.2032 meter/sec.

Example 13

The coated abrasive article for this example was made in the same manner as was used in Example 9, except that a different make coat precursor was employed.

Example 14

The coated abrasive article for this example was made in the same manner as was used in Example 10, except that a different make coat precursor was employed.

Example 15

The coated abrasive article for this example was made in the same manner as was used in Example 11, except that a different make coat precursor was employed.

Example 16

The coated abrasive article for this example was made in the same manner as was used in Example 12, except that a different make coat precursor was employed.

Example 17

The coated abrasive article for this example was made in the same manner as was used in Example 9, except that the thermal cure of 60 minutes at a temperature of 110° C. following the ultraviolet light cure was omitted.

TABLE IV

| Example | Ra | Rtm | Total cut (g) | Percent of Comparative Example A |
|---|---|---|---|---|
| 9 | 41 | 248 | 0.885 | 115 |
| 10 | 51 | 284 | 0.719 | 93 |
| 11 | 38 | 225 | 0.934 | 121 |
| 12 | 46 | 267 | 0.769 | 100 |
| 13 | 39 | 239 | 0.818 | 107 |
| 14 | 51 | 277 | 0.723 | 94 |
| 15 | 39 | 235 | 0.787 | 102 |
| 16 | 48 | 263 | 0.665 | 86 |
| 17 | 45 | 255 | 0.889 | 115 |
| Comp. A | 46 | 276 | 0.772 | 100 |
| Comp. B | 60 | 323 | 1.034 | 134 |

TABLE V sets forth 90° Peel Adhesion Test results for the coated abrasive articles in Examples 1–17 and Comparative Examples A, B, and D.

TABLE V

| Example | Force (kg/cm) |
|---|---|
| Comp. A | 1.5 |
| Comp. B | 2.4 |
| Comp. D | 1.9 |
| 1 | 1.2 |
| 2 | 1.7 |
| 3 | 1.6 |
| 4 | 1.1 |

TABLE V-continued

| Example | Force (kg/cm) |
|---|---|
| 5 | 1.7 |
| 6 | 1.1 |
| 7 | 1.4 |
| 8 | 0.9 |
| 9 | 1.6 |
| 10 | 2.3 |
| 11 | 1.7 |
| 12 | 2.1 |
| 13 | 1.4 |
| 14 | 2.2 |
| 15 | 1.6 |
| 16 | 2.0 |
| 17 | 1.4 |

The coated abrasive samples for Examples 9 through 17 were subjected to additional thermal cures at 110° C. for one hour, two hours, four hours, and six hours. After the thermal cure, the samples were tested for 90° peel adhesion and the results are set forth in TABLE VI.

TABLE VI

| | Force (kg/cm) | | | |
|---|---|---|---|---|
| Example | 1 hr. | 2 hr. | 4 hr. | 6 hr. |
| 9 | 1.9 | 1.9 | 2.4 | 2.3 |
| 10 | 2.4 | 2.1 | 2.4 | 2.4 |
| 11 | 1.9 | 1.8 | 2.1 | 2.2 |
| 12 | 2.1 | 2.1 | 2.2 | 2.3 |
| 13 | 1.8 | 1.9 | 2.1 | 2.2 |
| 14 | 2.2 | 2.0 | 2.3 | 2.4 |
| 15 | 1.7 | 1.5 | 1.8 | 1.9 |
| 16 | 1.9 | 1.8 | 2.1 | 2.2 |
| 17 | 1.7 | 1.6 | 2.1 | 2.2 |

The data in Examples 1–17 demonstrate that coated abrasive articles of this invention provide satisfactory performance, even though there is no treatment coat between the porous backing and the make coat.

Various modifications and alterations of this invention will become apparent to those skilled in the art without departing from the scope or spirit of this invention.

What is claimed is:

1. A method of making a coated abrasive article comprising the steps of:

a. providing a porous backing having a front side and a back side and an interstitial area therebetween, said backing having a porosity sufficient to allow 100 cubic centimeters of air to pass therethrough in less than 100 seconds;

b. applying a radiation curable make coat precursor to the front side of said backing so that said make coat precursor is in direct contact with said backing without substantially penetrating said interstitial area;

c. applying a multiplicity of abrasive grits into said make coat precursor;

d. exposing said make coat precursor to a source of radiation energy to at least partially cure said make coat precursor, whereby the make coat precursor seals the backing and serves to bond the abrasive grits to the backing;

e. applying a size coat precursor over said abrasive grits; and f. completely curing said make coat and said size coat precursors.

2. The process of claim 1 wherein said backing is made of cloth.

3. The process of claim 2 wherein said cloth is made from fibers selected from the group consisting of cellulosics, cottons, polyesters, polyamides, and blends of at least one polyester and at least one cotton.

4. The process of claim 1 wherein said make coat precursor is applied by means of a die coater.

5. The process of claim 1 wherein the source of radiation energy is selected from the group consisting of electron beam, ultraviolet light, and visible light.

6. The process of claim 1 wherein the viscosity of said make coat precursor ranges from about 500 to about 10,000 centipoise at 25° C.

7. A method of making a coated abrasive article comprising the steps of:

a. providing a porous backing having a from side and a back side and an interstitial area therebetween, said backing having a porosity sufficient to allow 100 cubic centimeters of air to pass therethrough in less than 100 seconds;

b. applying a radiation curable make coat precursor to the front side of said backing so that said make coat precursor is in direct contact with said backing without substantially penetrating said interstitial area;

c. applying a multiplicity of abrasive grits into said make coat precursor;

d. exposing said make coat precursor to a source of radiation energy to cure said make coat precursor, whereby the make coat precursor seals the backing and serves to bond the abrasive grits to the backing;

e. applying a size coat precursor over said abrasive grits; and f. completely curing said size coat precursor.

8. The process of claim 7 wherein said backing is made of cloth.

9. The process of claim 8 wherein said cloth is made from fibers selected from the group consisting of cellulosics, cottons, polyesters, polyamides, and blends of at least one polyester and at least one cotton.

10. The process of claim 7 wherein said make coat precursor is applied by means of a die coater.

11. The process of claim 7 wherein the source of radiation energy is selected from the group consisting of electron beam, ultraviolet light, and visible light.

12. The process of claim 7 wherein the viscosity of said make coat precursor ranges from about 500 to about 10,000 centipoise at 25° C.

13. A method of making a coated abrasive article comprising the steps of:

a. providing a porous backing having a from side and back side and an interstitial area therebetween, said backing having a porosity sufficient to allow 100 cubic centimeters of air to pass therethrough in less than 100 seconds;

b. applying a radiation curable make coat precursor to the front side of said backing so that said make coat precursor is in direct contact with said backing without substantially penetrating said interstitial area;

c. exposing said make coat precursor to a source of radiation energy to partially cure said make coat precursor;

d. applying a multiplicity of abrasive grits into said make coat precursor, whereby said make coat precursor seals said backing and serves to bond said abrasive grits to said backing;

e. applying a size coat precursor over said abrasive grits; and f. completely curing said make coat and said size coat precursors.

14. The process of claim 13 wherein said backing is made of cloth.

15. The process of claim 14 wherein said cloth is made from fibers selected from the group consisting of cellulosics, cottons, polyesters, polyamides, and blends of at least one polyester and at least one cotton.

16. The process of claim 13 wherein said make coat is applied by means of a die coater.

17. The process of claim 13 wherein the source of radiation energy is selected from the group consisting of electron beam, ultraviolet light, and visible light.

18. The process of claim 13 wherein the viscosity of said make coat precursor ranges from about 500 to about 10,000 centipoise at 25° C.

* * * * *

UNITED STATES PATENT AND TRADEMARK OFFICE

CERTIFICATE OF CORRECTION

PATENT NO.: 5,490,878

DATED: February 13, 1996

INVENTOR(S): Peterson et al.

It is certified that error appears in the above-identified patent and that said Letters Patent is hereby corrected as shown below:

Col. 18,

Claim 7, line 3, "a from side" should read –a front side--.

Claim 13, line 3, "a from side" should read –a front side--.

Signed and Sealed this

Fourteenth Day of October, 1997

Bruce Lehman

*Attest:*

BRUCE LEHMAN

*Attesting Officer*

*Commissioner of Patents and Trademarks*